US006009606A

United States Patent [19]

Voigtlaender et al.

[11] Patent Number: 6,009,606

[45] Date of Patent: Jan. 4, 2000

[54] DEVICE FOR CRIMPING OF SYNTHETIC BUNDLES OR SLIVERS OF YARNS

[75] Inventors: Carsten Voigtlaender, Schönböla; Joachim Brenk, Armstedt, both of Germany

[73] Assignee: Neumag-Neumuenstersche Mashinen-und Analagenbau GmbH, Neumuester, Germany

[21] Appl. No.: 09/029,458

[22] PCT Filed: Oct. 14, 1996

[86] PCT No.: PCT/EP96/04461

§ 371 Date: Mar. 5, 1998

§ 102(e) Date: Mar. 5, 1998

[87] PCT Pub. No.: WO97/14831

PCT Pub. Date: Apr. 24, 1997

[30] Foreign Application Priority Data

Oct. 16, 1995 [DE] Germany ..... 195 38 423

[51] Int. Cl.[7] ..... D02G 1/12

[52] U.S. Cl. ..... 28/248; 28/269

[58] Field of Search ..... 28/248, 250, 262, 28/263, 268, 269, 264

[56] References Cited

U.S. PATENT DOCUMENTS

| | | | |
|---|---|---|---|
| 2,820,988 | 1/1958 | Wegener | 28/250 |
| 2,856,640 | 10/1958 | Klein | 28/269 |
| 2,862,279 | 12/1958 | Fardon, Jr. et al. . | |
| 3,225,415 | 12/1965 | Stoveken et al. | 28/1 |
| 3,353,223 | 11/1967 | Coffin, Jr. et al. | 28/269 |
| 3,800,373 | 4/1974 | Fleissner | 28/263 |
| 4,041,584 | 8/1977 | Williamson | 28/269 |
| 4,408,377 | 10/1983 | Schippers | 28/250 |
| 4,547,934 | 10/1985 | Ford | 28/250 |
| 4,807,337 | 2/1989 | Fleissner | 28/269 |

FOREIGN PATENT DOCUMENTS

| | | |
|---|---|---|
| 0 268 031 | 5/1988 | European Pat. Off. . |
| 1 877 098 | 8/1963 | Germany . |
| 27 16 024 | 8/1979 | Germany . |

OTHER PUBLICATIONS

"Kraftmesslager", Brochure "Kraftaufnehmer fuer FMS–Bahnzugmess –und Regelsysteme", FMS Force measuring Systems AG, Oberglatt, Switzerland.

*Primary Examiner*—Amy B. Vanatta
*Attorney, Agent, or Firm*—Michael J. Striker

[57] ABSTRACT

A device for crimping synthetic bundles or slivers of yarns, the device has a stuffing box provided with an inlet for a yarn bundle or sliver and including a movable press plate and a stationary counter plate opposite to the press plate, two axially parallel rollers disposed at the inlet for the yarn bundle or sliver and forming a gap through which the yarn bundle or sliver enters the stuffing box, a pivot arm pivotally mounted on a stationary pivot bearing, one of the two axially parallel rollers being rotatably mounted at a fixed position in a machine frame, another of the two axially parallel rollers being seated on the pivot arm so as to be rotatable about a rotation axis thereof and the press plate being pivotally connected to the pivot arm by means of a rocker so as to be pivotable about the rotation axis of the roller seated on the pivot arm or another rotation axis parallel with the rotation axis of the roller seated on the pivot arm, whereby the gap between the rollers is varied, a contact pressure device for applying a contact-pressure force directed toward the counter plate to the press plate at an engagement point movable in a longitudinal direction of the stuffing box, an adjusting device for moving the engagement point of the contact-pressure forced on the press plate along the press plate, and a closed-loop control circuit unit for adjusting a reaction force acting between the rocker and the pivot arm to a predetermined fixed value by actuating the adjusting device.

4 Claims, 4 Drawing Sheets

DEVICE FOR CRIMPING OF SYNTHETIC BUNDLES OR SLIVERS OF YARNS

BACKGROUND OF THE INVENTION

The invention relates to a device for crimping of synthetic bundles or slivers of yarn.

It is based on devices that have been disclosed by German Utility Model DE 18 77 098 U, U.S. Pat. No. 2,862,279, or European Patent Disclosure EP 0 268 031 B1.

In the known devices, the rollers exert a normal to surface force on the entering yarn bundle or sliver. As a result of the corresponding frictional force, the bundle or sliver is pressed into the stuffing box. By contact pressure of the pressure plate against the material located in the stuffing box, the requisite counterforce to the frictional force acting on the rollers is generated. Moreover, a counterpressure acts on the pressure plate, arising from the restoring force of the compressed material in the stuffing box. This force is generally distributed unevenly over the length of the stuffing box and as a rule increases in the feeding direction. If the center point of the counterpressure forces does not agree with the engagement point of the resultant of the inherent weight of the pressure plate and the contact-pressure force that engages the pressure plate, then the reaction force required to maintain the equilibrium of forces of the pressure plate ensues between second roller and the pressure plate. This affects the normal to surface force exerted by the two rollers on the entering yarn bundle or sliver, because it is superimposed on the force exerted on the second roller.

In the stuffing boxes that can be found in the references listed above, the engagement point of the contact-pressure force is fixed. In EP 0 268 031 B1, it is located at the outlet of the stuffing box. The center point of the counterpressure forces is always located in the middle region of the stuffing box. In this device, a reaction force therefore always ensues between the pressure plate and the second roller. In the devices of the other two references listed above, the contact-pressure force engages the pressure plate in the region of the stuffing box. Once again, a reaction force that acts on the second roller is generally unavoidable. Only for a certain contact-pressure force does the engagement point described assure that no reaction force will act on the second roller.

For process-dictated reasons, if certain crimping properties or various materials for crimping are to be attained, the contact-pressure force must be adjusted to different values. Thus a device with a fixed engagement point can be selected, in such a way that no reaction force on the second roller arises, for only a single method. As soon as the contact-pressure force is adjusted, a reaction force ensues, which leads to a change in the normal to surface force. To attain the originally set normal to surface force, the force with which the second roller is acted upon must be varied. This variation is typically done by trial and error and is thus very expensive. The distribution of the counterpressure exerted by the trapped fiber material on the pressure plate depends on the operating state. For instance, it changes if there are fluctuations in yarn titer. This shifts the center point of the counterpressure forces. As a consequence, there is a variable reaction force over time. The resultant fluctuations in the normal to surface force acting on the yarn bundle or sliver traveling through impair the uniformity of the crimping.

From German Patent DE 2 716 024, a device for measuring the radial force acting on a roller bearing by means of elastically deformable members and an electrical signal transducer is known. These devices can be obtained under the designation "Kraftmeβlager" [Force Measuring Bearings] (Brochure entitled "Kraftaufnehmer fuir FMS-Bahnzugmeβ- und Regelsysteme" [Force absorbers for FMS web tension measuring and regulating systems] published by FMS Force Measuring Systems AG, Oberglatt, Switzerland). In the aforementioned patent, reference is also made to other devices for measuring radial bearing forces.

SUMMARY OF THE INVENTION

The object of the invention is to improve a device for cramping of synthatic bundles or slivers of yarn in such a way that more uniform crimping is attained, and there is no need to adjust the force with which the second roller is acted upon if the contact-pressure force changes.

In keeping with these objects, one feature of present invention resides, briefly stated, in a device for crimping synthetic bundles or slivers of yarns, the device comprising a stuffing box provided with an inlet for a yarn bundle or sliver and including a movable press plate and a stationary counter plate opposite to the press plate, two axially parallel rollers disposed at the inlet for the yarn bundle or sliver and forming a gap through which the yarn bundle or sliver enters the stuffing box, a pivot arm pivotally mounted on a stationary pivot bearing, one of the two axially parallel rollers being rotatably mounted at a fixed position in a machine frame, another of the two axially parallel rollers being seated on the pivot arm so as to be rotatable about a rotation axis thereof and the press plate being pivotally connected to the pivot arm by means of a rocker so as to be pivotable about the rotation axis of the roller seated on the pivot arm or another rotation axis parallel with the rotation axis of the roller seated on the pivot arm, whereby the gap between the rollers is varied, a contact pressure device for applying a contact-pressure force directed toward the counter plate to the press plate at an engagement point movable in a longitudinal direction of the stuffing box, an adjusting device for moving the engagement point of the contact-pressure forced on the press plate along the press plate, and closed-loop control circuit means for adjusting a reaction force acting between the rocker and the pivot arm to a predetermined fixed value by actuating the adjusting device.

BRIEF DESCRIPTION OF THE DRAWINGS

The other figures show an exemplary embodiment in simplified form; specifically.

DESCRIPTION OF PREFERRED EMBODIMENT

Figure 1:
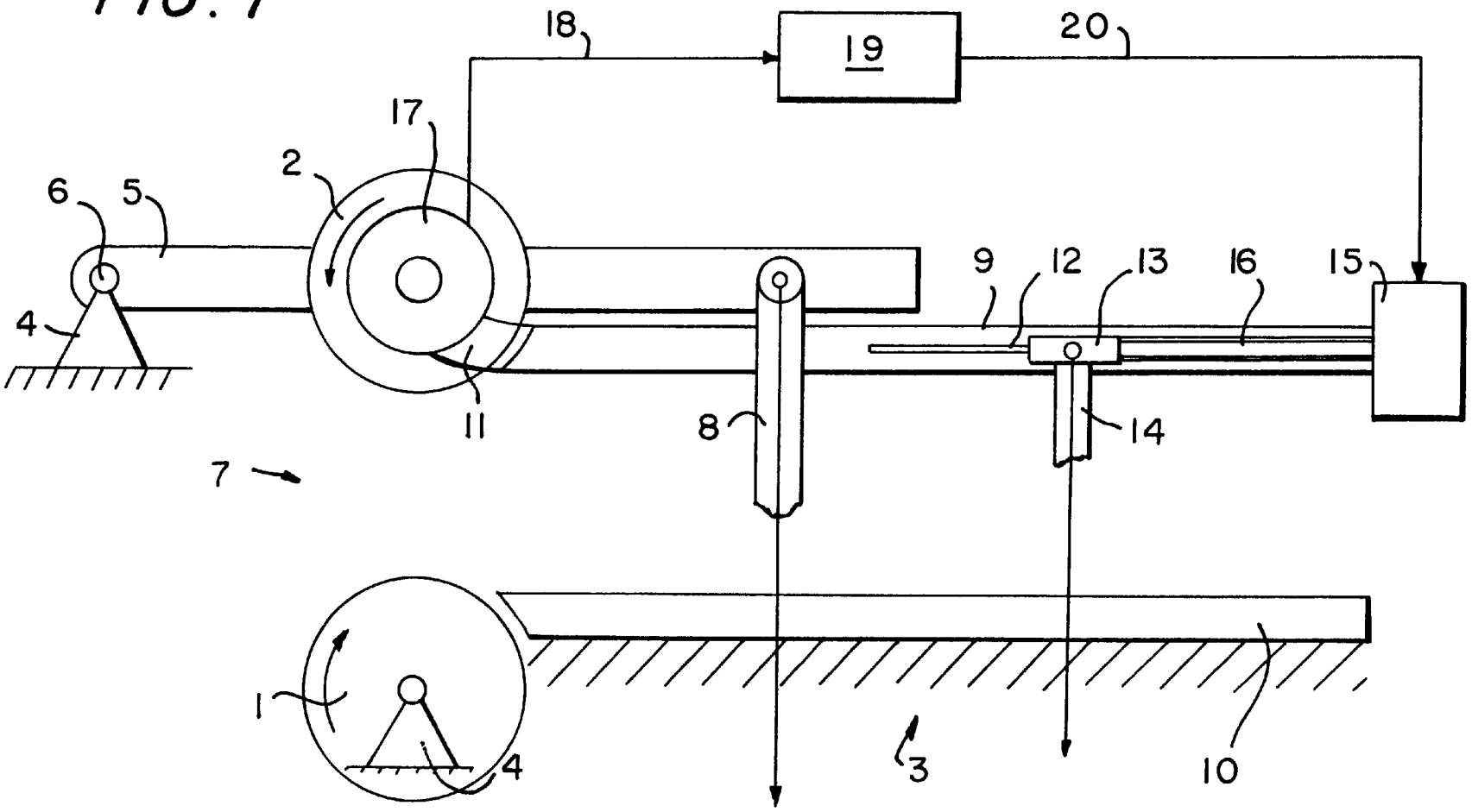
FIG. 1 illustrates the principle of the invention.
Figure 2:
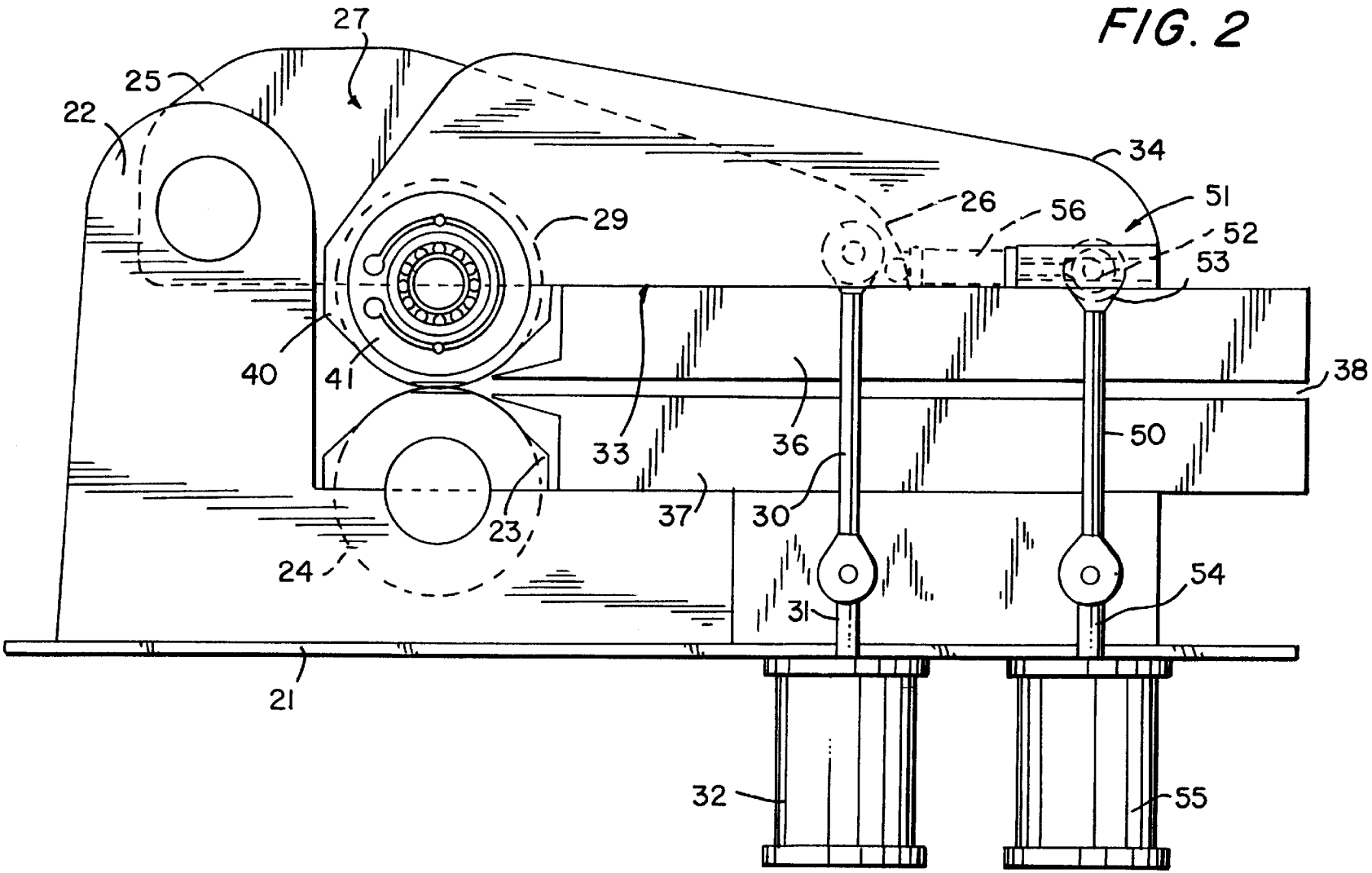
FIG. 2 shows the device from the side.
Figure 3:
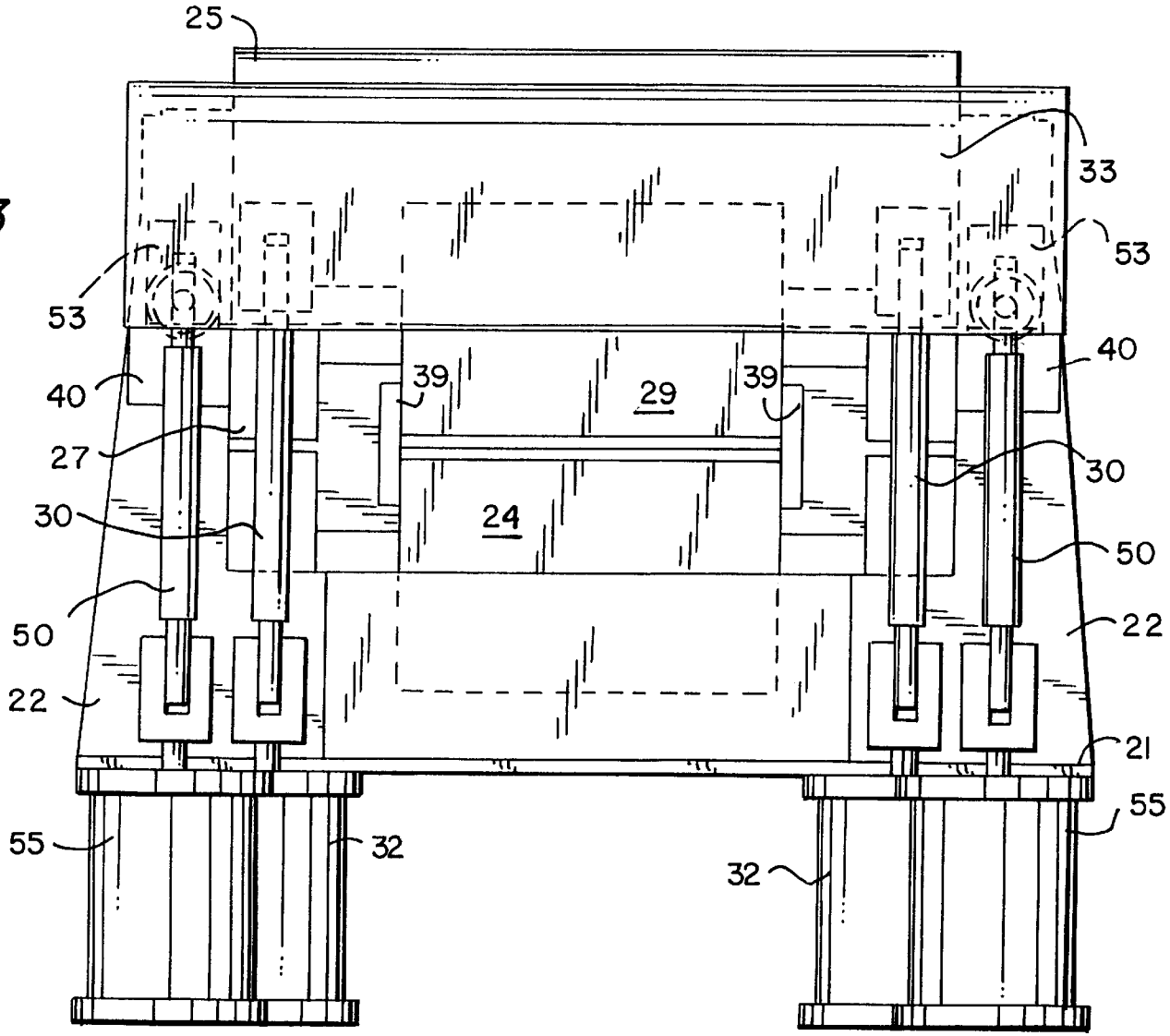
FIG. 3 shows the device from the front.
Figure 4:
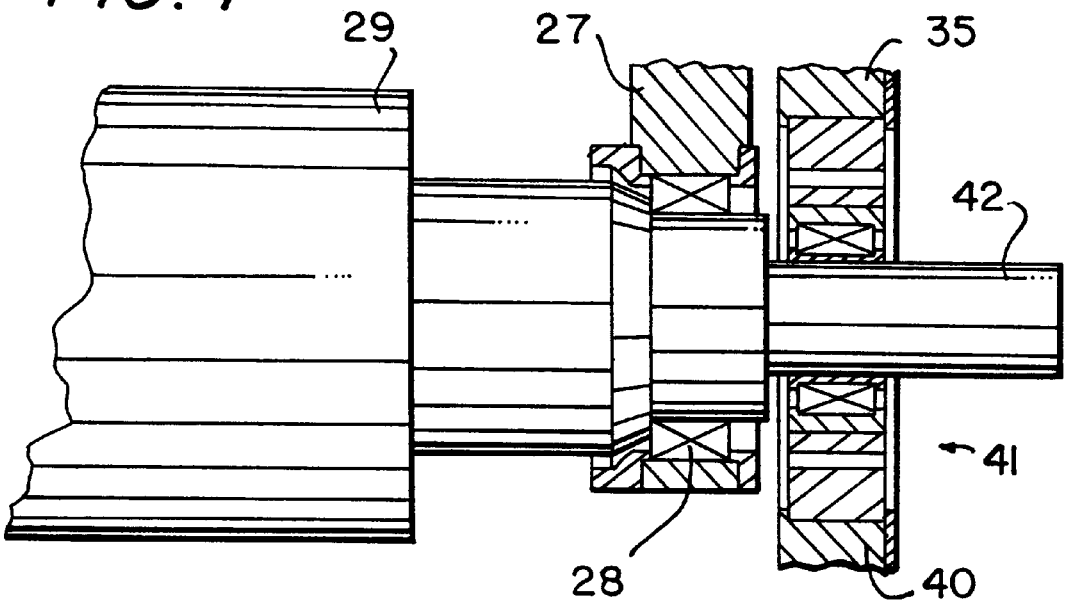
FIG. 4 shows a detail.

Two rollers 1, 2 driven in the direction indicated by arrows are disposed at the inlet to a stuffing box 3. The axes of the two rollers 1, 2 are parallel to one another. The bearings of the first roller 1 are immovably connected to a machine frame 4, which is shown in only suggested fashion in the drawing. The bearings of the second roller 2 are seated on a pivot arm 5, which is pivotably connected to pivot bearings 6 on the machine frame. By pivoting the pivot arms 5, the width of the gap 7 located between the rollers 1, 2 can be varied. The pivot arm 5 is engaged by two piston rods 8 or the like. As a result, the second roller 2 can be acted upon by a force that is aimed at the first roller 1.

The stuffing box has a rectangular cross section. It is enclosed by four wall plates, namely a pressure plate 9, a counterpart plate 10, and two side plates. These side plates are parallel to the plane of the drawing and are not shown in the drawing. Like the counterpart plate 10, they are fixedly connected to the machine frame.

The pressure plate 9 is joined on each side to a rocker 11 to form an intrinsically rigid unit. This unit is pivotably connected to the pivot arm 5, so that the pivot axis coincides with the axis of the roller 2.

A lateral groove 12 of the pressure plate 9, extending longitudinally, acts as a guide for a sliding block 13. This block is engaged by a rod 14 of a contact pressure device, such as the piston rod of a piston and cylinder unit, not shown, that is connected to the machine frame. An adjusting device 15 is secured laterally to the outlet end of the pressure plate 9 and is connected to the sliding block 13 by a coupling member 16. A force measuring sensor 17 is disposed at the link between the rocker 11 and the pivot arm 5 in such a way that it responds to a reaction force acting perpendicular to the pivot arm 5. The measuring sensor 17 is connected to the input of a closed-loop controller 19 by a measurement signal transmission line 18. For transmitting an adjusting signal formed by the controller 19, the controller 19 is connected to the adjusting device 15 by a line 20. The adjusting signal of the controller 19 causes the adjusting device 15 to displace the sliding block 13 in such a way that the reaction force is regulated to a predetermined, fixed value.

The sliding block 13 is preferably always moved by the adjusting device 15 into a position such that there is an equilibrium between the counterpressure exerted on the pressure plate 9 by the trapped fiber material on the one hand and the resultant force of the inherent weight of the pressure plate 9 and the contact-pressure force introduced via the piston rod 8, on the other. In this way, the reaction force is substantially kept at 0. The normal to surface force acting on the entering yarn bundle or sliver is therefore constant, regardless of changes in the operating state—except for slight closed-loop control fluctuations.

On a base plate 21, in the exemplary embodiment shown FIGS. 2–5, there is a machine housing 22, which is approximately in the form of an L lying on its back. A bearing 23 for the lower roller 24 is mounted on the longer, horizontally resting leg, closely adjacent to the vertically upward-pointing leg. The bearing of a pivot arm 25 is seated on the upper end of the vertical leg.

This pivot arm takes the form of a hood with an oblique top face 26 and vertical side cheeks 27. Bearings 28 for the upper roller 29 are mounted on the two side cheeks 27. Tie rods 30 are pivotably secured to the two side cheeks 27 on the front end of the pivot arm 25. They are pivotably connected to piston rods 31 of cylinders 32.

A rocker 33, which similarly to the pivot arm 25 is embodied in the form of a hood with a slightly sloping roof 34 and vertical side parts 35 (FIG. 4), is pivotably connected to the pivot arm 25 in a manner described in detail later herein. A pressure plate 36 is secured to the underside of the rocker 33. Between the pressure plate 36 and a counterpart plate 37 opposite it is the stuffing box 38. This box is laterally bounded by side plates 39.

Bearing blocks 40 are mounted on the underside of the side parts 35, and one force measuring bearing 41 is built into each bearing block. The two force measuring bearings 41 are seated on elongated shaft trunnions 42 of the upper roller 29.

Figure 5:
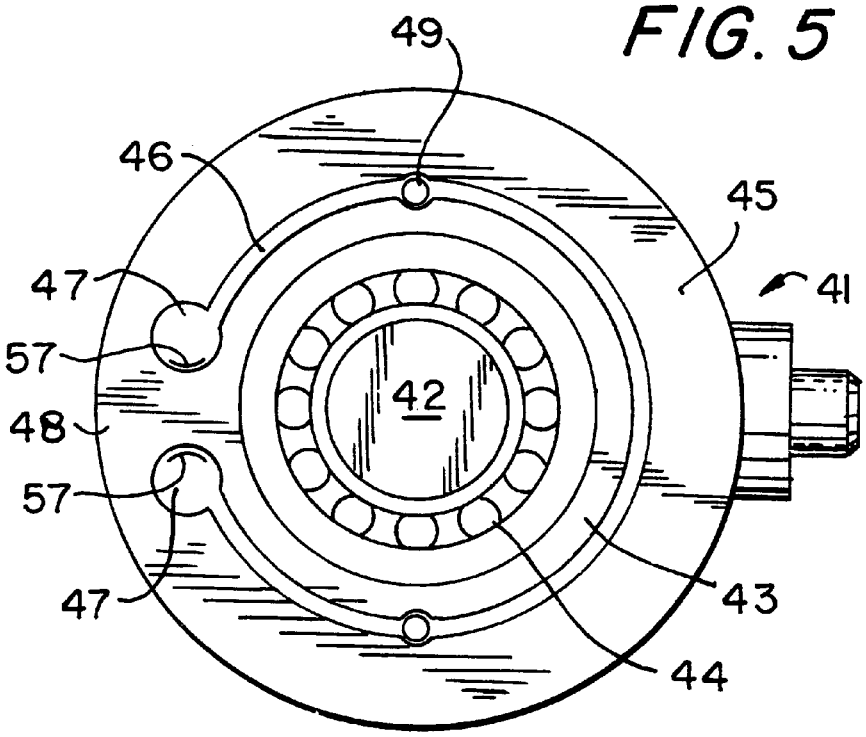
FIG. 5 shows another detail.

The force measuring bearing 41, in FIG. 5, comprises an inner ring 43, which receives a roller bearing 44 for the shaft trunnion 42, and an outer ring 45, which is fixedly connected to the bearing block 40. A gap 46 extends between the inner ring 43 and the outer ring 45, over an arc of more than 300°. On both ends, the gap 46 discharges into a respective bore 47, whose axis is oriented parallel to the axis of the force measuring bearing 41. The diameter of the bore 47 is substantially larger than the width of the gap 46. Located between the two bores 47 is a short radial strut 48, which connects the inner ring 43 with the outer ring 45. The strut 48 is disposed horizontally; that is, it is in the nine-o'clock position. At two points located in a vertical plane, that is, in the six-o'clock position and the twelve-o'clock position, the gap 46 has two opposed semicircular recesses. Bolts 49 are seated with play in them.

One tie rod 50 is connected to the front end of the rocker 33 on each of the two sides, joined by a link 51 that comprises a link trunnion 52 and a link eyelet 53 mounted on the tie rod 50. The two tie rods 50 are oriented essentially vertically and are connected to piston rods 54 of cylinders 55 that are seated below the base plate 21.

The link trunnion 52 is guided in a horizontal groove of the side parts 35 of the rocker 33, so that it is displaceable horizontally. The link trunnion 52 is engaged by a piston rod of a bidirectional cylinder 56, which is pivotably connected to the underside of the rocker 33 approximately in the middle.

Strain gauges 57 are glued to both sides of the strut 48. These strain gauges are integrated into an electrical measurement bridge in a known manner. If a reaction force acts vertically on the shaft trunnion 42, the strut 48 is subjected to bending strain and is deformed accordingly. The deformation causes a strain on the strain gauge 57. As a result, an electrical measurement signal that is a measure of the deformation and thus the reaction force is generated at the measurement bridge. The measurement signal is delivered to the input of a closed-loop controller. The controller compares the measurement signal with a predetermined guide variable and, on the basis of the ascertained difference, generates adjusting signals for valves, which affect the delivery of pressure fluid to the bidirectional cylinder 56 in the sense of negative feedback, so that the ascertained difference between the measurement signal and the guide variable is reduced. As a result, depending on the choice of guide variable, the reaction force is regulated either to zero or to a desired fixed value.

Assuming a guide variable corresponding to a zero reaction force, the rocker 33 would exert an upward-oriented reaction force on the trunnion 42 and thus also on the pivot arm 25. This means that the contact-pressure force brought to bear by the tie rods 50 has a longer lever arm, with respect to the pivot axis of the rocker 33, than the center point of the counterpressure forces. Correspondingly, the closed-loop controller varies the delivery of pressure fluid of the bidirectional cylinder 56 in such a way that the link trunnion 52 is displaced far enough toward the pivot axis that the reaction force disappears.

The bolts 49 protect the strut 48 against permanent deformation by acting as stops in the event of an overload.

We claim:

1. A device for crimping synthetic bundles or slivers of yarns, said device comprising a stuffing box provided with an inlet for a yarn bundle or sliver and including a movable press plate and a stationary counter plate opposite to the press plate; two axially parallel rollers disposed at the inlet for the yarn bundle or sliver and forming a gap through which the yarn bundle or sliver enters the stuffing box; a pivot arm pivotally mounted on a stationary pivot bearing, one of said two axially parallel rollers being rotatably mounted at a fixed position in a machine frame, another of said two axially parallel rollers being seated on said pivot arm so as to be rotatable about a rotation axis thereof and said press plate being pivotally connected to said pivot arm by means of a rocker so as to be pivotable about said rotation axis of said roller seated on said pivot arm or another rotation axis parallel with said rotation axis of said roller seated on said pivot arm, whereby said gap between said rollers is varied; a contact pressure device for applying a contact-pressure force directed toward the counter plate to the press plate at an engagement point movable in a longitudinal direction of the stuffing box; an adjusting device for moving the engagement point of the contact-pressure forced on the press plate along the press plate; and closed-loop control circuit means for adjusting a reaction force acting between said rocker and said pivot arm to a predetermined fixed value by actuating the adjusting device.

2. A device as defined in claim 1, wherein said closed-loop control circuit means is operative for adjusting the reaction force to zero.

3. A device as defined in claim 1; and further comprising a force measuring sensor which responds to a reaction force acting perpendicular to said pivot arm, said force measuring sensor being arranged at a link between said rocker and said pivot arm.

4. A device as defined in claim 1; and further comprising a force measuring bearing which is connected to said rocker and receives trunnions of said another roller.

* * * * *